United States Patent [19]

Melton

[11] 4,130,105

[45] Dec. 19, 1978

[54] AUXILIARY WOOD BURNING FURNACE

[76] Inventor: Leoda Melton, 134 S. Foster St., Mansfield, Ohio 44903

[21] Appl. No.: 812,663

[22] Filed: Jul. 5, 1977

[51] Int. Cl.[2] ..... F24B 7/02

[52] U.S. Cl. ..... 126/110 R; 126/111; 237/53

[58] Field of Search ..... 126/110 R, 110 B, 111, 126/67; 237/51-53

[56] References Cited

U.S. PATENT DOCUMENTS

| | | | |
|---|---|---|---|
| 2,321,132 | 6/1943 | Czaja | 126/70 X |
| 3,945,369 | 3/1976 | Adams et al. | 126/121 X |
| 3,994,276 | 11/1976 | Pulver | 126/270 |
| 4,047,515 | 9/1977 | Daniel | 126/67 X |
| 4,049,194 | 9/1977 | Tice et al. | 237/1 A |

*Primary Examiner*—William E. Wayner
*Assistant Examiner*—William E. Tapolcai, Jr.
*Attorney, Agent, or Firm*—Bacon & Thomas

[57] ABSTRACT

A conventional forced air furnace and an auxiliary wood burning furnace are separately connected directly to hot air distribution and cold air return air ducts. Each furnace has its own air circulating blower and an automatically operable damper valve prevents each furnace from blowing hot air through the other.

5 Claims, 2 Drawing Figures

AUXILIARY WOOD BURNING FURNACE

BACKGROUND OF THE INVENTION

This invention is in the field of heating systems and particularly systems employing a conventional forced air furnace and an auxiliary solid fuel burning heater.

Much combustible solid material, including wood, is wasted by the average household thus throwing an unnecessarily heavy demand on conventional furnace systems which use scarce and expensive fuels. A system for efficiently using such waste materials for heating would not only help in preserving a clean environment but would also reduce the demand for scarce and expensive fuels.

It has already been proposed to combine solid fuel and fluid fuel furnaces, to be used selectively for heating an enclosure. U.S. Pat. No. 3,834,619 proposes an arrangement wherein an enclosed fireplace may be operated to heat air for distribution through the ducts of a conventional furnace. U.S. Pats. 2,525,400; 3,066,655; 3,994,276 and 4,020,822 all disclose unitary furnace structures capable of deriving heat from different selected sources. In each of the above patents, however, a single blower is used. The use of a single blower in such a system as that of U.S. Pat. No. 3,834,619 means that much of the heat produced by the auxiliary burner is wasted and lost in heating the structure of the conventional furnace through which it is drawn.

SUMMARY OF THE INVENTION

In the following description reference to a "wood" burning device is intended to include the burning of any combustible solid material.

The present invention resides principally in the provision of an auxiliary wood burner having a cold air inlet and hot air outlet respectively connected to the return duct and distribution duct of an already-installed conventional furnace. The auxiliary wood burner is provided with its own blower so that the air heated thereby does not flow through the conventional furnace but is sent directly to the enclosure to be heated.

DESCRIPTION OF A PREFERRED EMBODIMENT

Figure 1:
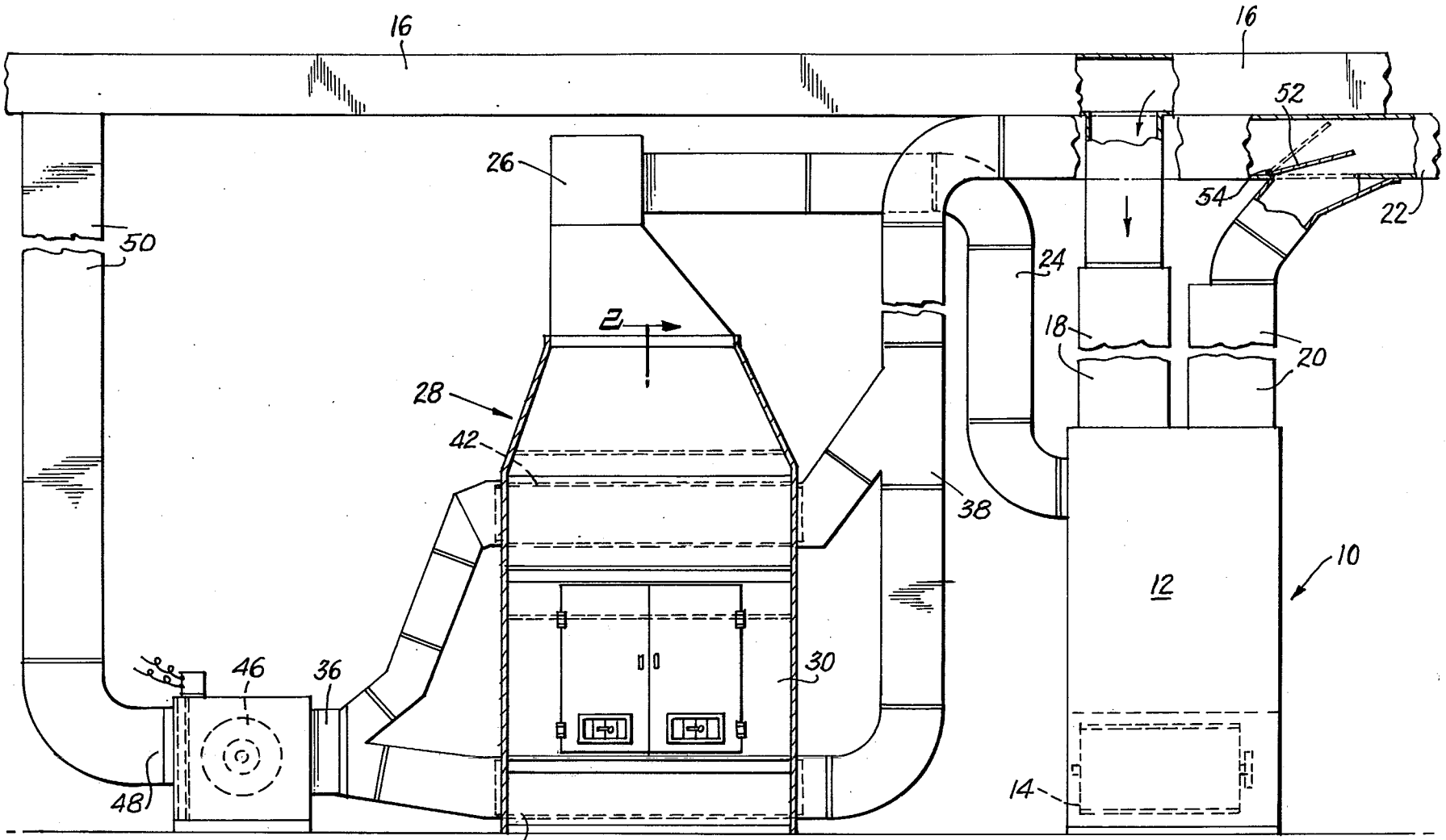
FIG. 1 is a schematic view of the system of the present invention.

In FIG. 1, numeral 10 indicates generally a conventional forced air furnace having a firebox, and heat exchange arrangement 12 along with a conventional blower 14 for drawing air from a return duct 16 through an inlet 18 and blowing the same through the heat exchange arrangement in 12 to the outlet 20 and thence to distribution duct 22. The structure thus far is conventional wherein the distribution duct 22 directs heated air to the enclosure to be heated, such as the rooms of a house or the like, and from which return duct 16 extends. Products of combustion flow through an exhaust duct 24 to an exhaust flue 26. According to the invention an auxiliary wood burning furnace 28 is provided and which comprises a firebox region 30 in which a fire may be kindled to burn wood, waste materials or other solid fuel.

Figure 2:
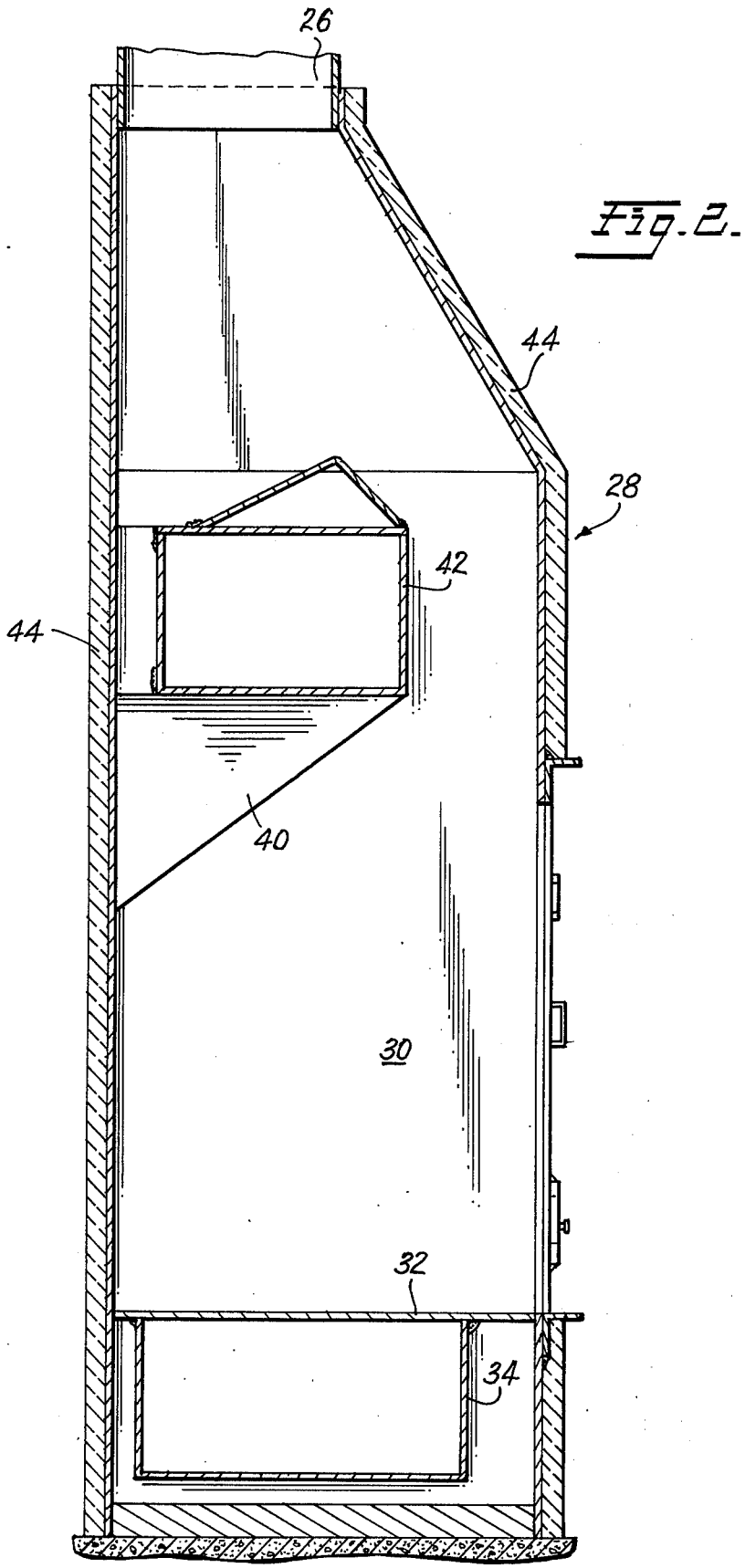
FIG. 2 is a somewhat enlarged sectional view taken on the line 2—2 of FIG. 1.

Referring to FIG. 2, the firebox 30 is only schematically shown, it being contemplated that it be provided with a suitable grate or the like to support the burning material. The bottom of the firebox is defined by a continuous imperforate wall 32, a portion of which form one wall of a duct 34 extending therebelow and through the furnace from an inlet fitting 36 (FIG. 1) to an outlet fitting 38 (FIG. 1). As shown in FIG. 2, the duct 34 is in intimate heat conductive relation to the firebox 30. In the upper region or flue chamber of the firebox 30, suitable brackets 40 are provided on which a second air duct 42 is supported. The duct 42 extends through the wood burning furnace in spaced relation to the side walls thereof so that hot gases from the fire may flow around all sides of the duct to heat the air flowing therethrough. The products of combustion are then directed upwardly to the exhaust flue 26. As shown in FIG. 1, the duct 42 is also connected at one end to the inlet fitting 36 and as its outlet end to the outlet fitting 38.

The entire wood burning furnace may be very inexpensively constructed from sheet metal although it will preferably be enclosed by suitable sheath of heat insulating material 44. Obviously, the woodburning furnace may be in the form of an enclosed fireplace set into a wall or the like.

The inlet fitting 36 previously referred to, constitutes the outlet or discharge portion of a second blower 46. The inlet 48 of the blower 46 is connected through duct 50 to the return duct 16 previously referred to and the outlet fitting 38 is connected to the distribution duct 22, as clearly shown in FIG. 1. At the juncture between the forced air furnace outlet 20 and distribution duct 22, there is provided a flap valve 52 freely pivoted at 54 in position to fall by gravity to a position (shown in dotted line) closing the outlet 20 of the conventional forced air furnace 10. The valve 50 may also be forced upwardly to the upper dotted line position for a purpose to be described.

When only the forced air furnace 10 is in operation, cold return air is drawn through the inlet 18, heated and discharged through outlet 20 to duct 22. During this operation the force of the hot air lifts valve 52 to the upper dotted line position to thus effectively prevent blowing any of the heated air backwardly through the wood burning furnace 28. When the blower 14 of the forced air furnace is not operating and the auxiliary heater and blower 46 are in operation, the latter blows cold return air through both ducts 34 and 42 to heat the same and thence directs the heated air into distribution duct 22. At this time not only gravity but the force of the air being delivered to the distribution duct maintains the valve 52 in its lower dotted line position and thus prevents blowing of the hot air from the wood burning furnace in reverse direction through the furnace 10.

Obviously, either furnace may be controlled by a thermostat and under extreme conditions both furnaces may be in simultaneous operation with the valve 52 assuming an intermediate position as shown in full lines in FIG. 1.

One of the advantages of the present invention resides in the fact that heat produced by the wood burning furnace 28 is delivered directly to the distribution duct by an independent fan or blower 46. This eliminates forcing of the hot air from furnace 28 through furnace 10, which would result in considerable heat loss by having to heat all of the material and structure of the furnace 10 before effective heating of the enclosure would be accomplished.

Another advantage resides in the fact that the auxiliary heater can be installed inexpensively to combine with an existing forced air furnace.

While a single specific embodiment of the invention has been shown and described, the same is merely illustrative of the principles involved and other forms may be resorted to within the scope of the appended claims.

I claim:

1. In combination:

a forced air furnace having a firebox, a hot air outlet connected to a distribution duct, a return duct, and a first blower for receiving air through said return duct and blowing the same through said hot air outlet to said distribution duct;

a wood burning furnace separate from said forced air furnace, said wood burning furnace having a firebox, a second outlet, a second inlet, and a second blower for blowing air from said second inlet to said second outlet;

first conduit means connecting said second outlet directly to said distribution duct;

second conduit means connecting said return duct directly to said second blower; and the fireboxes of both said furnaces being provided with exhaust means connected to a common flue.

2. The combination of claim 1, including a damper valve at the juncture of said hot air outlet and said distribution duct, said damper valve being responsive to air flowing from said hot air outlet to block said first conduit means and responsive to air flowing in said first conduit means to close said hot air outlet.

3. The combination of claim 1 wherein said wood burning furnace comprises:

a housing having side walls and a partition therein spaced upwardly from the bottom of said housing and defining a firebox thereover, the upper portion of said firebox defining a flue chamber;

a first air duct extending through said housing below said partition and in heat conductive relation thereto;

a second air duct extending through said housing, through said flue chamber; and said first and second ducts being connected to said second inlet and second outlet respectively.

4. The combination of claim 3 including a blower arranged to blow air through said second inlet to both said ducts.

5. The combination of claim 3 wherein at least said second air duct is spaced throughout its periphery from adjacent walls of said housing.

* * * * *